United States Patent [19]

Reed, Jr.

[11] Patent Number: 4,651,419

[45] Date of Patent: Mar. 24, 1987

[54] DOUBLE ENDED SINGLE BLADE KNIFE

[76] Inventor: August D. Reed, Jr., Beaverton, Oreg.

[21] Appl. No.: 796,660

[22] Filed: Nov. 8, 1985

[51] Int. Cl.[4] ..... B26B 3/06

[52] U.S. Cl. ..... 30/152; 30/155; 30/161

[58] Field of Search ..... 30/153, 155–161, 30/330, 337, 152; 7/168

[56] References Cited

U.S. PATENT DOCUMENTS

| | | | |
|---|---|---|---|
| 300,858 | 6/1884 | Feicker | 30/157 X |
| 1,036,664 | 8/1912 | Marble | 7/168 |
| 2,820,291 | 1/1958 | Philippar | 30/153 |

*Primary Examiner*—E. R. Kazenske

*Assistant Examiner*—Michael D. Folkerts

*Attorney, Agent, or Firm*—Olson and Olson

[57] ABSTRACT

A knife comprises three main parts: a handle, a blade and a removable spring lock guard. The handle, formed of two spaced apart lateral handle halves includes a blade pivot adjacent its forward end. The blade, configured as a double-ended, double-edged single blade, is mounted intermediate its ends to the blade pivot for rotation to positions in which one of its ends is contained within a slot provided between the handle halves while its opposite end extends forwardly of the handle for use. A spring lock guard is configured to releasably overlie the slot in the handle and confine the inoperative blade, thereby securely locking the single blade against inadvertent rotation during use.

4 Claims, 6 Drawing Figures

DOUBLE ENDED SINGLE BLADE KNIFE

BACKGROUND OF THE INVENTION

This invention relates to knives generally carried in scabbards such as camping, hunting and hiking knives, and more particularly to such knives having interchangeable blades arranged to be put into and out of operative position selectively as desired.

Knives, and other generally similar tools having interchangeable blades and other implements are known in the art. Examples of such devices are illustrated in U.S. Pat. Nos. 300,858; 4,169,312; and 4,391,043. The latter two U.S. patents disclose knife constructions which utilize removable blades configured to be releasably attached to a handle member for individual use, and easily removable therefrom for installation of a replacement blade.

U.S. Pat. No. 300,858 discloses a construction more generally pertinent to the present invention for disclosing a tool having a handle member which rotatably mounts a double-ended blade having a cutting blade at one of its ends and a nut pick at its end opposite. Specifically, a handle member comprises two sapced apart lateral halves joined together at their rear end by a rivet. The forward end of the handle member includes a pivot which receives the intermediate portion of the blade for rotation of the blade 180° about the axis of the pivot so that the nut pick or the blade may be contained within the confines of the handle member halves while the blade or nut pick projects outwardly therefrom for use. A cam and socket type stop arrangement is provided to releasably position the blade or nut pick to project from the handle member for use. An abutment stop is also provided at the rear end of the handle member and is configured for abutment by the nut pick to prevent rotation of the blade when downward force is applied to the blade during use and for abutment by the blade to prevent rotation of the nut pick when upward force is applied to it during use.

In all examples above, the knife constructions necessarily are somewhat complex and susceptible to wear and consequent failure. The latter two patents identified involve constructions which are susceptible to accidental release of the blade during use by inadvertent unlocking of the blade securing mechanism during manipulation of the knife. The first reference utilizes a construction which provides no positive locking arrangement which will reliably hold the blade in operative position when pressure is applied in any direction over than downwardly against the working surface of the knife blade, or will hold the nut pick in operative position when pressure is applied to it in any direction other than upwardly. In this regard, this knife arrangement presents a hazard to the user in that inadvertent rotation of the blade during use and even when carrying the knife can occur and cause the user serious cuts.

SUMMARY OF THE INVENTION

In its basic concept this invention provides a double-ended single bladed tool mounted rotatably on a handle and having a spring lock guard removably encircling the handle to confine the inoperative tool within the handle and secure the operative tool against displacement relative to the handle.

It is by virtue of the foregoing basic concept that the principal objective of this invention is achieved; namely, the provision of a double-bladed knife or other tool which overcomes the disadvantages and limitations of similar tools of the prior art.

Another object of this invention is the provision of a tool of the class described in which two tools may be configured as desired to perform specific functions, examples being one knife blade end configured as a hunting knife, and the other blade end configured for fishing purposes.

Another object of this invention is the provision of a tool of the class described in which the tool member may be configured with other than sharp knife edges, as with screw drivers, files and the like.

A further object of this invention is the provision of a tool of the class described which permits easy interchangeability of the tool ends while also affording reliable safety against the inadvertent release of the working tool from its operative position.

A still further object of this invention is the provision of a tool of the class described which is of simplified construction for economical manufacture and reliability of use.

The foregoing and other objects and advantages of this invention will appear from the following detailed description, taken in connection with the accompanying drawings of a preferred embodiment.

DESCRIPTION OF THE PREFERRED EMBODIMENT

A rotatable blade tool, embodied herein as a scabbard type knife, comprises basically three main parts; namely, a two-piece handle member, a blade and a spring lock guard. In the embodiment illustrated, the purpose of this invention is to provide a knife with two different types of edges on the opposite ends of a single centrally rotatable blade, and to provide a handle that allows each edge to be put in operative position at the option of the user, with locking means interconnecting the blade and the handle to releasably and positively lock the blade in the desired position during use.

Figure 1:
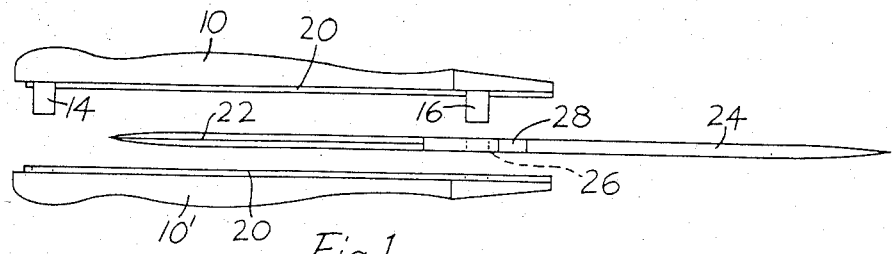
FIG. 1 is an exploded plan view of the two-piece member and the double-ended, double-edged, rotatable single blade of a knife embodying the features of this invention.
Figure 4:
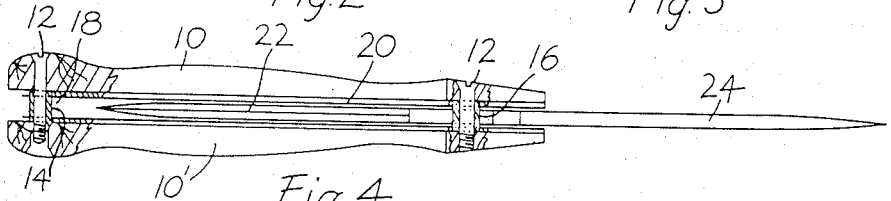
FIG. 4 is a plan view of the knife of FIG. 1 shown in assembled but unlocked condition permitting rotation of the blade about its pivot axis on the handle, parts being broken away to show internal detail.

Referring now to the drawings, and particularly to FIGS. 1 and 4, a handle member includes two lateral halves 10, 10' joined together at their front and rear ends by screws 12, as shown, or by rivets, pins, or other suitable connecting means. As illustrated, spacing sleeves 14, 16 are provided between the lateral halves 10, 10' at their connection to each other to maintain the handle member halves at a preselected distance apart from each other, thus defining a fixed open slot 18 (FIG. 4) through the handle. The front sleeve 16 provides a bearing surface forming a blade pivot as will become apparent later.

As seen in FIGS. 1–4, each handle member half includes an inwardly projecting recessed edge which extends about the periphery of the opened slot 18, the facing recessed surfaces thereby providing a ledge 20 which acts as a spring lock guard track, as in FIGS. 5 and 6, for purposes which will be explained in detail later. This ledge 20 may be formed in any conventional manner such as by molding the handle members of synthetic resin, or by cutting away material from the handle member halves, or by any other suitable means as may be desired. In the illustrated embodiment, a metal plate 20' is affixed to the inward side of each handle member half, the plate being reduced in cross sectional dimensions so as to produce a desired recessed edge surface ledge 20.

A double-ended single blade is configured at its opposite working end portions with two different working edges 22, 24. For descriptive purposes herein, the blade illustrated is arranged at one of its ends as a fishing blade 22 and at its opposite end as a hunting blade 24. The working edges of each blade end are preferably formed on opposite side edges of the single blade, as shown.

Intermediate the longitudinal ends of the single blade, at substantially its longitudinal center, there is provided a bore 26 arranged to receive the bearing sleeve 16 of the handle for rotation of the blade thereabout. Hence, as in FIG. 4, with the handle halves joined together and the single blade interposed between them and secured pivotally therebetween on the pivot illustrated, the blade is permitted 360° rotation about the axis of the bearing sleeve 16.

Figure 5:
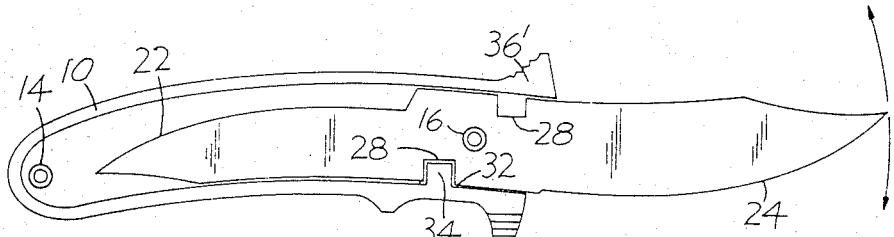
FIG. 5 is a side elevation of the knife of FIG. 4 with the bottom handle half removed and a removable spring lock guard interengaging the top handle half and the rotatable blade for securing the latter in locked, operative position, the facing handle half being removed in order to show internal detail otherwise hidden.
Figure 6:
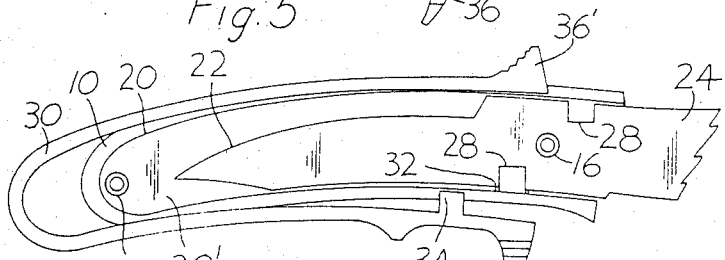
FIG. 6 is a fragmentary side elevation of the knife of FIG. 5 showing the spring lock guard in partially released condition either prior to its complete removal from the handle in order to allow rotation of the blade, or prior to complete installation on the handle to lock the blade against rotation.

With reference now primarily to FIGS. 5 and 6, a notch 28 is provided as shown on opposite edges of the blade rearwardly of each working surface associated with each end of the blade and symmetrically to opposite sides of bore 26. These notches provide means by which a spring lock guard may engage the blade in order to secure it into a fixed position of adjustment wherein one blade end, 22 illustrated, is contained within the handle in the slot 18 between the halves 10, 10' and the opposite, working blade end 24 extends outwardly from the handle for use.

Means is provided to secure the single blade against rotation when either blade end is in operative position. In the embodiment illustrated, a separate spring lock guard is configured essentially as an open ended C-shaped ring 30 arranged to be slid over the handle, as in FIG. 6, over the slot 18 between the handle halves 10, 10', the spring lock guard being supported and guided by the recessed tracks 20 encircling the slot. By virture of its particular configuraton, the spring lock guard, when fully slid onto the handle, is disposed within the recessed portions of the handle fully encircling and covering the open slot 18 and preferably having an outside surface being substantially flush with the outside surface of the handle, for comfort during use.

Figure 2:
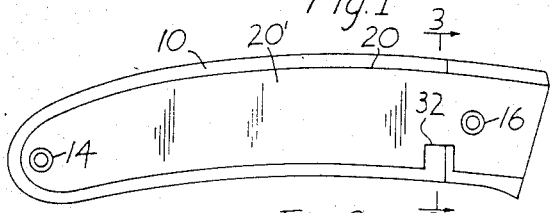
FIG. 2 is a side elevation of the handle half shown at the top in FIG. 1.
Figure 3:
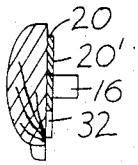
FIG. 3 is a sectional view of the handle half of FIG. 2, taken along the line 3—3 of FIG. 2.

As seen in FIG. 2, each handle half 10, 10' includes a cooperating inwardlly projecting notch 32 disposed to register with one of the notches 28 on the single blade when a cutting blade 22 or 24 is positioned for use. The spring lock guard is configured as illustrated in FIGS. 5 and 6, with an inwardly projecting pawl 34 positioned to extend through the registering notches 28, 32 in the blade and handle when the lock guard is fully pressed onto the handle. The inherent inward resiliency of the spring lock guard assures positive movement of the pawl into the notches and also holds the guard securely on the handle covering the slot 18.

The front ends of the spring lock guard may be configured as illustrated with outwardly projecting finger pull tabs 36 and 36'. The pull tabs enhance the handling of the knife, assist in assuring that the user's hand doesn't slide forwardly onto the cutting edge of the blade during use, and facilitates the release of the spring lock guard when desired by providing a convenient projection which can be grasped in order to pull the spring lock guard outwardly to release the pawl 34 from the registering notches 28, 32 so that the lock guard may be removed by sliding it rearwardly to enable rotating the blade.

As will be apparent to those skilled in the art, the lock guard is secured to the handle against inadvertent removal by virtue of the pawl's extension into the body of the handle through the notches 28, 32. Rearward sliding of the spring lock guard is thus rendered impossible without first intentionally pulling outwardly on the finger pull tab 36 against the inherent resilient tension of the spring lock guard itself. The knife blade end interposed between the handle halves is solidly captured therein by engagement of the pawl 34 and the notch 28, and also by virtue of the spring lock guard overlying and closing the open slot 18. Hence, the blade is fixed immovably in a manner in which inadvertent rotation of the blade is completely impossible, particularly when one considers that when a user grasps the handle, the pressure of his grip assists the spring lock guard to remain engaged in its locked position. In this manner, it is readily apparent that, as distinguished from the constructions of the exemplified prior art, the chance of accidental release of the blade is eliminated. Rather, the grasping and manipulations which heretofore have rendered previous constructions at a disadvantage serve to provide a secondary safety feature to the user which absolutely ensures against the inadvertent rotation of the blade during use.

With the knife of this invention locked with one blade in operative condition, the interchanging of the working portions of the blade is as follows: The spring lock guard 30 is removed by pulling outwardly on the finger pull tab 36 against the inherent inward tension of the spring lock guard a distance sufficient for the pawl 34 to be removed from the notches 28, 32. The spring lock guard is then slid rearwardly along the recessed track 20 and removed from the handle, opening the slot 18 between the handle member halves. The blade is then rotated 180° about the axis of its pivot 16 on the forward end of the handle. The spring lock guard thereafter is again positioned on the handle and slid forwardly along the track 20 until the pawl 34 aligns with the notches 28, 32 and snaps inwardly into locked condition.

From the foregoing it will be apparent that the knife of this invention is of simplified and economical construction that provides very reliable and effective utility and is extremely attentive of safety wherein the locking means is involved. Further, the lock guard 30 allows the bore 26 to be displaced from the longitudinal center of the single blade to provide the end portions of different lengths, if so desired.

From the foregoing it will also be apparent to those skilled in the art that various changes may be made in the size, shape, type, number and arrangement of parts described hereinbefore without departing from the spirit of this invention and the scope of the appended claims. For example, although the single blade has been described herein as having hunting and fishing knife cutting edges, it will be understood that the blades may be of identical shape to provide a sharp reserve edge. The single blade may also be configured as kitchen or other desired style of blades in any desired combination. It may also provide a variety of screw driver heads, file heads, saw blades, or any other desired tool or instrument configuration as may be advantageous to a user.

As another example, a second pawl 34 may extend inwardly from adjacent the pull tab 36' for retractable entry into additional notches 32 in the handle halves registering with the second notch 28 in the blade. Also, the pawl 34 may be dimensioned for reception only in notches 32 in the handle halves or only in notches 28 in the blade, whereby to eliminate the need for registering notches 28 or 32, respectively. Although the screw 12 supporting the pivot sleeve 16 may be replaced with a rivet, the screw is preferred since it allows easy removal and exchange of blades.

Having thus described my invention and the manner in which it may be used, I claim:

1. A rotatable blade tool, comprising:

(a) a handle having spaced apart lateral handle halves joined together and mounting blade pivot means between the halves adjacent the forward end of the handle, (b) a single, double ended, elongated blade tool member interposed between said spaced apart handle halves and mounted intermediate the ends of the blade tool member to said blade pivot means for rotation of the blade tool member to positions in which one inoperative end of the blade tool member is selectively disposed between said handle halves and the other, operative end projects forwardly from the handle for use, and (c) lock guard means configured to releasably overlie the space between the handle halves and confine the inoperative blade end therein and to lock the blade tool member against rotation about said pivot axis, (d) said lock guard means comprising an open end resilient guard member configured to be inserted forwardly onto the handle to releasably close the space between the handle halves, a pawl member on the guard member arranged for removable reception in a notch in one or both of the blade tool member and handle halves.

2. The rotatable blade tool of claim 1 including a finger pull tab on the resilient guard member adjacent the pawl for retracting the pawl from said notch.

3. The rotatable blade tool of claim 1 wherein the handle halves are provided on their inner sides with a projecting ledge surface forming a lock guard guide track configured to receive said overlying resilient guard member.

4. The rotatable blade tool of claim 3 wherein the projecting ledge surface on each handle half is formed by a metal plate secured to the inner face of the handle half.

* * * * *

UNITED STATES PATENT AND TRADEMARK OFFICE

CERTIFICATE OF CORRECTION

PATENT NO. : 4,651,419

DATED : March 24, 1987

INVENTOR(S) : Reed, Del

It is certified that error appears in the above-identified patent and that said Letters Patent is hereby corrected as shown below:

Column 1, line 24, "sapced" should read -- spaced --.

line 50, "over" should read -- other --.

Column 2, line 36, "of" should read -- in --.

Column 6, line 5, after "member" insert -- about a pivot axis defined by said blade pivot means --.

Signed and Sealed this

Eighth Day of September, 1987

*Attest:*

DONALD J. QUIGG

*Attesting Officer*

*Commissioner of Patents and Trademarks*